United States Patent [19]

Baumann

[11] 4,315,529

[45] Feb. 16, 1982

[54] WEAVING MACHINE HAVING MEANS FOR VENTILATING A WEFT SUPPLY MEANS

[75] Inventor: Heinz Baumann, Winterthur, Switzerland

[73] Assignee: Sulzer Brothers Limited, Winterthur, Switzerland

[21] Appl. No.: 58,246

[22] Filed: Jul. 17, 1979

[30] Foreign Application Priority Data

Jul. 17, 1978 [CH] Switzerland ..... 7684/78

[51] Int. Cl.[3] ..... D03D 49/00

[52] U.S. Cl. ..... 139/1 C

[58] Field of Search ..... 139/1 R, 1 C; 66/125 A; 68/5 R, 8

[56] References Cited

U.S. PATENT DOCUMENTS

| | | | |
|---|---|---|---|
| 2,491,092 | 12/1949 | Denney | 139/1 C |
| 2,944,414 | 7/1960 | Malloy et al. | 139/1 C |
| 3,127,911 | 4/1964 | Maguire | 139/1 C |

*Primary Examiner*—Henry Jaudon

*Attorney, Agent, or Firm*—Kenyon & Kenyon

[57] ABSTRACT

The weaving machine as provided with a means for directing an air flow past the weft supply means. The air flow serves to clean the bobbins, yarn storage device and other weft supply elements outside the shed in order to remove fluff which might otherwise enter into the shed.

10 Claims, 2 Drawing Figures

Figure 1:
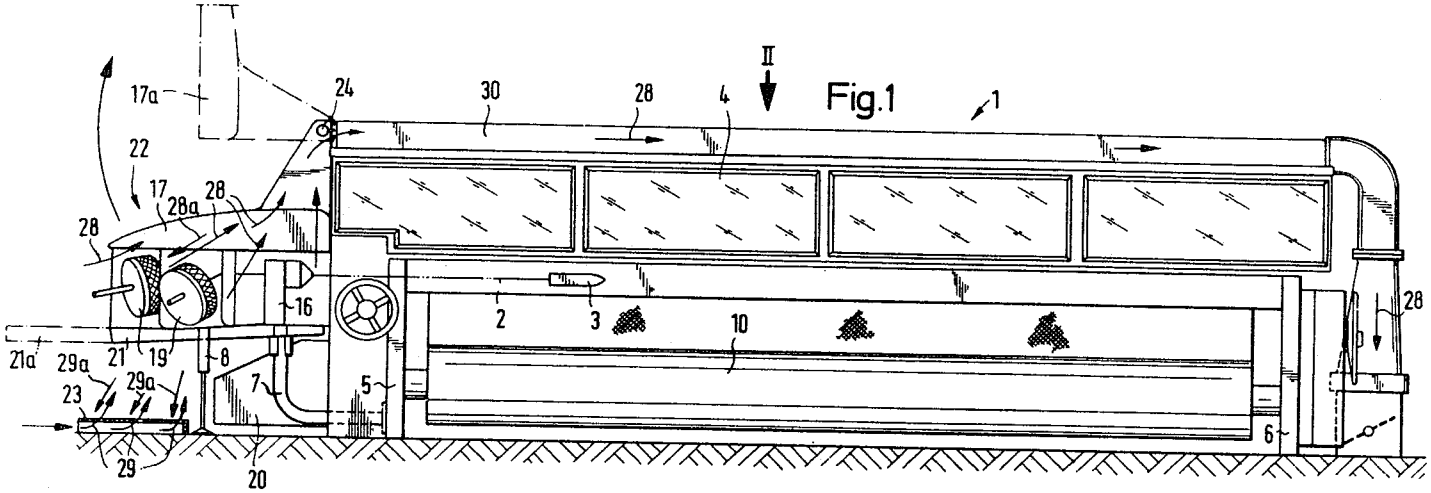

II
1
2
3
4
5
6
7
8
10
16
17
17a
19
19'
20
21
21a
22
23
24
28
28a
29
29a
30

1
2
4
5
6
7
11
16
16'
17, 21
19
21a
22
26
28
30

WEAVING MACHINE HAVING MEANS FOR VENTILATING A WEFT SUPPLY MEANS

This invention relates to a weaving machine having a weft supply means. More particularly, this invention relates to a weaving machine having a means for directing an air flow past a weft supply means.

Heretofore, it has been known to provide weaving machines with ventillating systems, for example as described in Swiss Pat. No. 490,549. Generally, these ventillating systems extend only over the cloth width of the machine, that is, the ventillating systems are generally provided only above the warp beam, heedles forming a shed, reed and cloth beam. Usually, the parts which remain outside the shed when the machine is in operation, particularly, a weft supply means having a plurality of weft supply bobbins, yarn brakes, weft storage devices and the like are not serviced by the ventillating systems. However, it is precisely at the weft supply means that a relatively large quantity of fluff collects in operation since the weft yarns generally experience a large number of deflections at this point.

Accordingly, it is an object of the invention to ventillate the weft supply means of a weaving machine which is disposed outside the shed.

It is another object of the invention to provide a relatively simply ventillating system for ventillating the weft supply means of a weaving machine.

Briefly, the invention is directed to a weaving machine which comprises a machine frame, means mounted on the frame for forming a shed of warp yarns and a weft supply means disposed outside the shed for supplying a weft thread to the shed. In accordance with the invention, the weaving machine is also provided with a means mounted on the frame for directing an air flow past the weft supply means. This latter means includes an air-guiding device which is disposed above the weft supply means and is in the form, for example, of an air exhaust hood which is hingedly mounted on the frame. When in operation, the air directing means serves to produce an air flow which flows past and through the weft supply means. Consequently, fluff can be removed from those parts of the web supply means where particularly heavy collections of dust and fluff occur due to deflections of the yarn and abrasion in the brakes and guides. In addition, the yarn material to be processed can be given a conditioning treatment as early as the weft supply means.

In another embodiment, a fluff catcher can be disposed below the weft supply means to receive any fluff which falls under gravity from the weft supply means. Also, an additional means can be disposed below the weft supply means for directing air over the weft supply means. In this regard, this means may either blow air toward the weft supply means and into the overlying exhaust hood or may be used in a reverse manner with the hood such that air is blown from the hood downwardly over the weft supply means while the lower means is used as a suction duct to draw in air.

Figure 2:
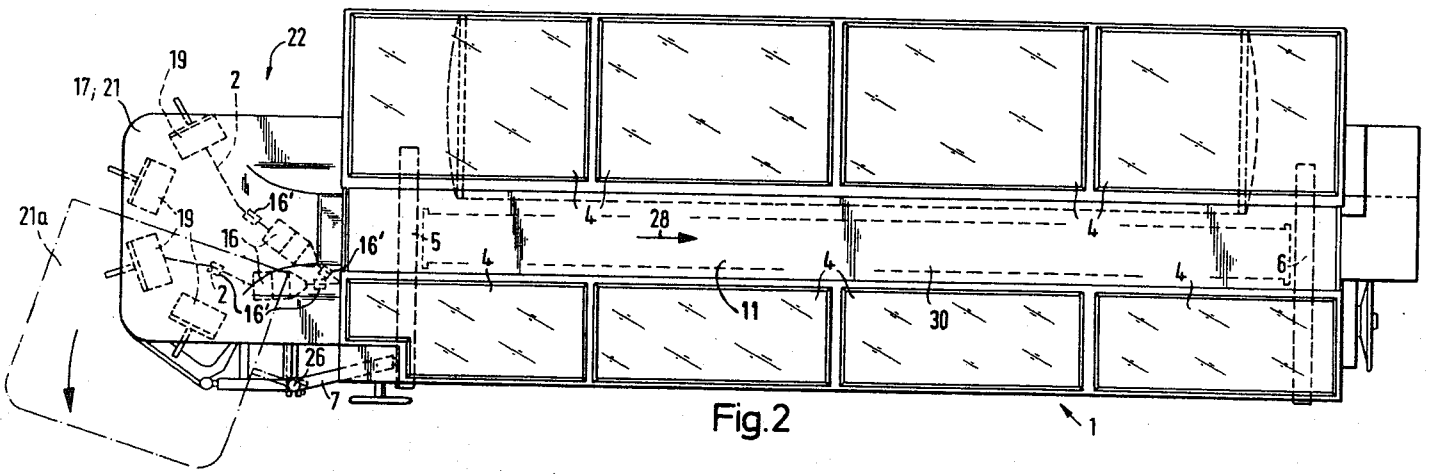

These and other objects and advantages of the invention will become more apparent from the following detailed description taken in conjunction with the accompanying drawings wherein:

FIG. 1 illustrates a diagrammatic view of a weaving machine according to the invention as viewed from the cloth end; and FIG. 2 illustrates a plane view corresponding to FIG. 1.

Referring to FIG. 1, the weaving machine 1 is of generally known construction and has a machine frame which has a means 11 (FIG. 2) mounted thereon for forming a shed (not shown) of warp yarns in a given region of the frame. In addition, a weft supply means 22 is disposed outside the region in which the shed is formed for supplying a weft yarn 2 to the shed, for example, by means of a gripper projectile 3.

The weft supply means 22 includes a plurality of weft supply bobbins 19, a drum-type storage device 16, and other elements such as yarn guides, yarn brakes 16' and the like (not shown). As indicated, the bobbins 19 are mounted on a bobbin frame 7 which is secured to the upright 5 and are supported by a support 8 (see FIG. 1). During operation, with the bobbins 19 remaining outside the shed, weft yarn 2 is drawn off one of the supply bobbins 19 and passes through the drum-type storage device 16. At any given time, a length of weft yarn sufficient for a cloth width is usually in the store of the storage device 16.

The weaving machine also has a plurality of cover flaps 4 at the warp end and cloth end and two side uprights 5,6 along the sides of the machine. In addition, a cloth beam 10 is mounted at the cloth end of the weaving machine to take up the cloth which is produced.

Referring to FIG. 1, a means is mounted on the machine frame for directing an air flow past the weft supply means 22. As indicated, this means includes an air guiding device in the form of an air exhaust hood 17 which is disposed above the weft supply means 22. This hood 17 is hingedly mounted on an exhaust duct 30 on the machine frame via a horizontal pivot 24 and can be hinged up into a position **17*a* as shown in chain dotted lines so as to permit access to the bobbins 19, storage device 16** and so on.

Referring to FIG. 1, a fluff catcher 21 in the form of a plate is disposed below the weft supply means 22, particularly below the bobbins 19 and storage device 16 so as to catch fluff which falls under gravity from the weft supply means. The plate 21 is pivotable about a pivot 26 (see FIG. 2) so as to be pivoted into a position **21*a*** as shown in chain lines.

Referring to FIGS. 1 and 2, the hood 17 is in communication with the exhaust duct 30 which extends across the width of the weaving machine and terminates at a suitable facility for drawing air through the hood 17 and duct 30 as indicated by the arrows 28. During operation, as air is drawn through the exhaust duct 30, an air flow is directed over and past the weft supply means into the hood 17 and, thus, into the duct 30. In this way, the weaving shed can be kept very clean since any fluff, dust or the like which occurs in the weft supply means can be drawn off.

If required, the fluff catcher 21 can be omitted. In this case, a means is provided below the weft supply means for directing air upwardly over the weft supply means. As shown, this means is in the form of an air supply duct 23 which serves to direct a bottom air flow in the direction indicated by the arrows 29.

Alternatively, the hood 17 may be utilized as an air supply hood so that a reverse air flow is formed in the direction indicated by the arrow **28*a*. In this case, the duct 23 can be used as a suction duct so as to draw in air as indicated by the arrows 29*a***.

It is to be noted that the operation of the weaving machine can proceed with only bottom extraction, that is, air need only be drawn through the duct 23 in the direction indicated by the arrow 29*a*. In this case, the hood 17 can be omitted.

The air which is supplied can be conditioned, that is, brought to a "climate" (temperature and humidity) suitable for the yarn material to be processed. In this event, the weaving machine is provided with a built-in air conditioning. Further, it may be unnecessary to provide an air conditioning plant for the complete weaving shed. However, if air is merely extracted from the weft supply means 22 without any supply of air and, if conditioning of the yarn material is necessary, a conditioning plant must be provided in the weaving shed.

It is to be noted that the storage device 16 and bobbins 19 may be dispersed on a separate movable frame which can be pushed under the hood 17.

What is claimed is:

1. A weaving machine comprising a machine frame;

first means mounted on said frame for forming a shed of warp yarns in a given region of said frame;

a weft supply means disposed outside said region for supplying a weft yarn to said region, said weft supply means including at least one weft bobbin, a yarn brake and a weft storage means; and second means mounted on said frame for directing an air flow past said weft supply means, said second means including a hood extending over said weft supply means.

2. A weaving machine as set forth in claim 1 which further comprises an exhaust duct extending over said frame for conducting a flow of air therethrough and wherein said hood is mounted on said exhaust duct and is in communication with an interior of said exhaust duct.

3. A weaving machine as set forth in claim 2 wherein said hood is hingedly mounted on said exhaust duct about a horizontal pivot.

4. A weaving machine as set forth in claim 2 which further comprises a fluff catcher disposed below said weft supply means.

5. A weaving machine as set forth in claim 2 which further comprises means below said weft supply means for directing air over said weft supply means.

6. A weaving machine as set forth in claim 5 wherein said means below said weft supply means is a suction duct.

7. A weaving machine as set forth in claim 1 which further comprises means below said weft supply means for directing air over said weft supply means.

8. A weaving machine comprising a machine frame;

means mounted on said frame for forming a shed of warp yarns in a given region of said frame;

a weft supply means disposed outside said shed for supplying a weft thread to said shed, said weft supply means including at least one weft bobbin;

an exhaust duct extending over said frame for drawing an air flow therethrough; and an exhaust hood hingedly mounted on said exhaust duct and extending over said weft supply means, said hood being in communication with said duct for directing an air flow over and past said weft supply means into said hood and said exhaust duct.

9. A weaving machine as set forth in claim 8 which further comprises a fluff catcher below said weft supply means.

10. A weaving machine as set forth in claim 8 which further comprises an air supply duct below said weft supply means to direct a flow of air upwardly through said weft supply means towards said hood.

* * * * *